US008959873B2

(12) United States Patent
Longhenry

(10) Patent No.: US 8,959,873 B2
(45) Date of Patent: Feb. 24, 2015

(54) METHOD OF SEALING A CORE HOLE

(71) Applicant: Charles C. Longhenry, Aubrey, TX (US)

(72) Inventor: Charles C. Longhenry, Aubrey, TX (US)

(73) Assignee: Longhenry Industries, Inc., Aubrey, TX (US)

( * ) Notice: Subject to any disclaimer, the term of this patent is extended or adjusted under 35 U.S.C. 154(b) by 0 days.

(21) Appl. No.: 14/195,112

(22) Filed: Mar. 3, 2014

(65) Prior Publication Data

US 2014/0174024 A1 Jun. 26, 2014

Related U.S. Application Data

(62) Division of application No. 13/125,076, filed as application No. PCT/US2009/061301 on Oct. 20, 2009, now Pat. No. 8,661,758.

(60) Provisional application No. 61/107,205, filed on Oct. 21, 2008.

(51) Int. Cl.
*E02D 37/00* (2006.01)
*E04B 1/66* (2006.01)
(Continued)

(52) U.S. Cl.
CPC ..... *E04B 1/948* (2013.01); *E04G 23/0203* (2013.01); *E04B 1/66* (2013.01); *E04G 23/02* (2013.01)
USPC ..... 52/741.4; 52/514; 52/514.5; 52/742.13; 428/63; 264/46.4; 264/46.5; 264/46.7

(58) Field of Classification Search
USPC ..... 52/514, 514.5, 741.4, 741.41, 742.1, 52/742.13, 742.14, 742.15; 277/630, 637; 428/63; 264/46.4, 46.5, 46.7; 425/127, 425/110, 11; 249/39; 156/71, 78, 79, 94, 156/293, 305; 29/527.1, 527.2
See application file for complete search history.

(56) References Cited

U.S. PATENT DOCUMENTS 348,341 A 8/1886 Potter
503,079 A 8/1893 Gowen
(Continued)

OTHER PUBLICATIONS

Suzo-Happ webpage http://www.happcontrols.com/accessories/27037900.htm, Jul. 8, 2009, pp. 1-2.
(Continued)

*Primary Examiner* — Robert Canfield
*Assistant Examiner* — Charissa Ahmad
(74) *Attorney, Agent, or Firm* — Grady K. Bergen; Griggs Bergen LLP

(57) ABSTRACT

A seal assembly (10) is provided for sealing a core hole (52) formed in a concrete slab (54) having opposite first and second surfaces, with the core hole (52) extending between the first and second surfaces. The seal assembly (10) comprises a cover assembly (12) having a cover plate (14) that is configured for engaging the first surface of the concrete slab (54) and seating over and covering the core hole (52). The cover assembly (12) has a lower plate (16) that is configured for being received within the core hole (52). The lower plate (16) is coupled to the cover plate (14) through a support member (20) so that the lower plate (16) is spaced apart from the cover plate (14) when the cover plate (14) is seated over the core hole (52) to define a cavity between the lower plate (16) and the cover plate (14). A locking element carrier (26) is coupled to the cover assembly (12). A locking element (40) is movably coupled to the carrier (26) and facilitates securing the seal assembly (10) to the concrete slab (54). The cavity of the seal assembly may be filled with an insulating material (62).

18 Claims, 6 Drawing Sheets

(51) Int. Cl.

| | |
|---|---|
| ***E04B 1/94*** | (2006.01) |
| ***E04G 23/02*** | (2006.01) |

(56) References Cited

U.S. PATENT DOCUMENTS

| | | | | | |
|---|---|---|---|---|---|
| 978,380 | A | | 12/1910 | Kennedy | |
| 1,229,429 | A | | 6/1917 | Farley | |
| 2,139,491 | A | | 12/1938 | Dawson | |
| 2,512,188 | A | * | 6/1950 | Wait et al. | 248/27.1 |
| 2,598,194 | A | | 5/1952 | Shippey | |
| 2,638,774 | A | | 5/1953 | Wieman | |
| 2,997,416 | A | * | 8/1961 | Helton | 156/98 |
| 3,443,716 | A | | 5/1969 | Evans | |
| 3,834,107 | A | | 9/1974 | Standing | |
| 3,846,604 | A | * | 11/1974 | Shallbetter | 200/297 |
| 3,911,635 | A | * | 10/1975 | Traupe | 52/220.1 |
| 3,946,636 | A | | 3/1976 | Grey | |
| 3,999,347 | A | | 12/1976 | Devlin | |
| 4,061,344 | A | | 12/1977 | Bradley et al. | |
| 4,100,712 | A | | 7/1978 | Hyman | |
| 4,189,891 | A | | 2/1980 | Johnson et al. | |
| 4,270,318 | A | | 6/1981 | Carroll et al. | |
| 4,297,823 | A | | 11/1981 | Keisler | |
| 4,354,332 | A | | 10/1982 | Lentz | |
| 4,370,842 | A | | 2/1983 | Martin et al. | |
| 4,406,107 | A | | 9/1983 | Schoonbeck | |
| 4,432,465 | A | | 2/1984 | Wuertz | |
| 4,471,594 | A | * | 9/1984 | Doyle | 52/514 |
| 4,607,469 | A | * | 8/1986 | Harrison | 52/220.8 |
| RE32,678 | E | * | 5/1988 | Benscoter et al. | 52/220.8 |
| 4,809,478 | A | * | 3/1989 | Bernard | 52/514 |
| 4,820,564 | A | * | 4/1989 | Cologna et al. | 428/63 |
| 4,932,179 | A | * | 6/1990 | Sosinski | 52/232 |
| 5,033,949 | A | * | 7/1991 | Jewett | 425/12 |
| 5,243,802 | A | * | 9/1993 | Zetena, Jr. | 52/514 |
| 5,269,114 | A | * | 12/1993 | Albers et al. | 52/698 |
| 5,297,691 | A | | 3/1994 | Bottcher | |
| 5,732,526 | A | * | 3/1998 | Farley | 52/741.3 |
| 5,954,095 | A | * | 9/1999 | Grigory et al. | 138/98 |
| 6,662,490 | B1 | | 12/2003 | Aesch, Jr. | |
| 6,769,222 | B2 | * | 8/2004 | Billante | 52/741.15 |
| 7,121,054 | B2 | * | 10/2006 | Shock | 52/514.5 |
| 7,740,028 | B1 | * | 6/2010 | Wilson et al. | 138/99 |
| 7,836,659 | B1 | * | 11/2010 | Barnes | 52/742.14 |
| 2003/0101668 | A1 | * | 6/2003 | Monden et al. | 52/220.8 |
| 2005/0129482 | A1 | | 6/2005 | Wang | |
| 2008/0083185 | A1 | * | 4/2008 | Lin | 52/514 |

OTHER PUBLICATIONS

International Search Report and Written Opinion of ISA dated Dec. 14, 2009 for PCT/US2009/061301, pp. 1-8.

* cited by examiner

METHOD OF SEALING A CORE HOLE

CROSS-REFERENCE TO RELATED APPLICATIONS

This application is a division of U.S. application Ser. No. 13/125,076, filed Apr. 20, 2011, now U.S. Pat. No. 8,661,758, which claims priority on International Application No. PCT/US2009/061301, filed Oct. 20, 2009, which claims the benefit of U.S. Provisional Application No. 61/107,205, filed Oct. 21, 2008, each of which is incorporated herein by reference in its entirety.

BACKGROUND

In commercial interior finish out, there is always the problem of abandoned core holes and penetrations in the concrete slab between floors. Typically, contractors and building engineers are required to seal these penetrations with concrete to maintain the fire rating of the slab. The process involved in doing this is very involved, expensive, time consuming and may be disruptive to existing tenants in the space below. Because of the effort and expense required to seal the core holes with concrete, workers may cut corners by simply placing a thin metal cover plate over the hole and then float the floor. No insulation or fire rating is provided with such an installation.

The present invention provides an effective means for sealing core holes that is quick, simple to carry out, inexpensive, non-disruptive to existing tenants and that maintains the fire rating of the concrete slabs.

SUMMARY

A seal assembly for sealing a core hole formed in a concrete slab having opposite first and second surfaces is provided. The core hole extends between the first and second surfaces. The seal assembly has a cover assembly that includes a cover plate that is configured for engaging the first surface of the concrete slab and seating over and covering the core hole. The cover assembly further includes a lower plate that is configured for being received within the core hole. The lower plate is coupled to the cover plate through a support member so that the lower plate is spaced apart from the cover plate when the cover plate is seated over the core hole to define a cavity between the lower plate and the cover plate.

A locking element carrier, which may be an elongated threaded member, of the seal assembly is coupled to the cover assembly and extends from the cover assembly through the core hole when the cover plate is seated over the core hole. A locking element of the seal assembly is movably coupled to the locking element carrier. The locking element is configured for movement between first and second positions. The locking element is configured to pass through the core hole while in the first position when the locking element carrier is passed through the core hole. The locking element is configured to engage the second surface of the concrete slab when in the second position to prevent passage of the locking element through the core hole. The locking element is selectively movable upon the locking element carrier to facilitate securing the seal assembly to the concrete slab.

The locking element carrier may form the support member in certain embodiments. In certain applications, the lower plate may be adjustably coupled to the cover plate through the support member so that the lower plate may be selectively spaced apart from the cover plate at different positions. In certain embodiments, an insulating material may be provided that generally fills the cavity between the cover plate and lower plate. At least one aperture may be formed in the cover plate to allow the introduction of an insulating material into the cavity when the cover plate is seated over the core hole.

In certain embodiments, the locking element has a threaded portion that engages the elongated threaded member, and wherein rotating the elongated threaded member facilitates movement of the locking element along the length of the elongated threaded member to thereby tighten or loosen the locking element. The elongated threaded member may extend to the cover plate and be provided with an engagement portion at the cover plate to allow the elongated threaded member to be rotated to thereby tighten or loosen the locking element.

In another embodiment, a seal assembly for sealing a core hole is formed in a concrete slab having opposite first and second surfaces. The core hole extends between the first and second surfaces. The seal assembly includes a cover plate that is configured for engaging the first surface of the concrete slab and seating over and covering the core hole. The cover plate is generally a flat plate that is sized to completely cover core hole at the first surface. The seal assembly further includes a lower plate that is configured for being received within the core hole. The lower plate is adjustably coupled to the cover plate through at least one threaded support member so that the lower plate may be selectively spaced apart from the cover plate at different positions. A cavity is defined within the core hole between the cover plate and the lower plate when the cover plate is seated over the core hole. An elongated threaded member is coupled to the cover plate and extends from the cover plate through the core hole when the cover plate is seated over the core hole to a position below the lower plate.

A locking element of the seal assembly is coupled to the elongated threaded member below the lower plate. The locking element is configured for movement between first and second positions. The locking element is sized to pass through the core hole while in the first position when the elongated member is passed through the core hole, and wherein the locking element is sized to prevent passage of the locking element through the core hole and to engage the second surface of the concrete slab when in the second position. The locking element may be selectively movable along the length of the elongated member to facilitate securing the seal assembly to the concrete slab.

In certain embodiments, the elongated member may form the support member. The locking element may be configured for pivotal movement between the first and second positions. In certain embodiments, an insulating material that generally fills the cavity between the cover plate and lower plate may be provided. At least one aperture may be formed in the cover plate to allow the introduction of an insulating material into the cavity when the cover plate is seated over the core hole. The insulating material may be an expandable spray foam.

In certain applications, the elongated member is threaded and the locking element has a threaded portion that engages the threaded elongated member. Rotating the elongated member facilitates selective movement of the locking element along the length of the elongated member to thereby tighten or loosen the locking element. The elongated member may extend to the cover plate and be provided with an engagement portion at the cover plate to allow the elongated member to be rotated to thereby tighten or loosen the locking element.

A method of sealing a core hole is also provided. The core hole is formed in a concrete slab having opposite first and second surfaces with the core hole extending between the first and second surfaces. The method includes providing a seal assembly for sealing the core hole. The seal assembly includes a cover assembly that includes a cover plate and a lower plate that is coupled to the cover plate through a support member. The seal assembly also includes a locking element carrier that is coupled to the cover assembly and extends from the cover assembly through the core hole when the cover plate is seated over the core hole. A locking element is further provided with the seal assembly. The locking element is movably coupled to the locking element carrier. The locking element is configured for movement, which may be pivotal movement, between first and second positions. The locking element is configured to pass through the core hole when the locking element carrier is passed through the core hole while in the first position. The locking element is configured to engage the second surface of the concrete slab when in the second position and prevent passage of the locking element through the core hole. The locking element is selectively movable on the locking element carrier to facilitate securing the seal assembly to the concrete slab.

The method includes installing the seal assembly by passing the locking element carrier and locking element through the core hole while the locking element is in the first position. The locking element is moved to the second position so that the locking element engages the second surface of the concrete slab. The locking element is moved upon the locking element carrier to facilitate securing the seal assembly to the concrete slab so that the cover plate engages the first surface of the concrete slab and seats over and covers the core hole. The lower plate member is received within the core hole and is spaced apart from the cover plate when the cover plate is seated over the core hole to define a cavity between the lower plate and the cover plate.

An insulating material may be further introduced into the cavity between the lower plate and the cover plate. The insulating material may be an expandable spray foam.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
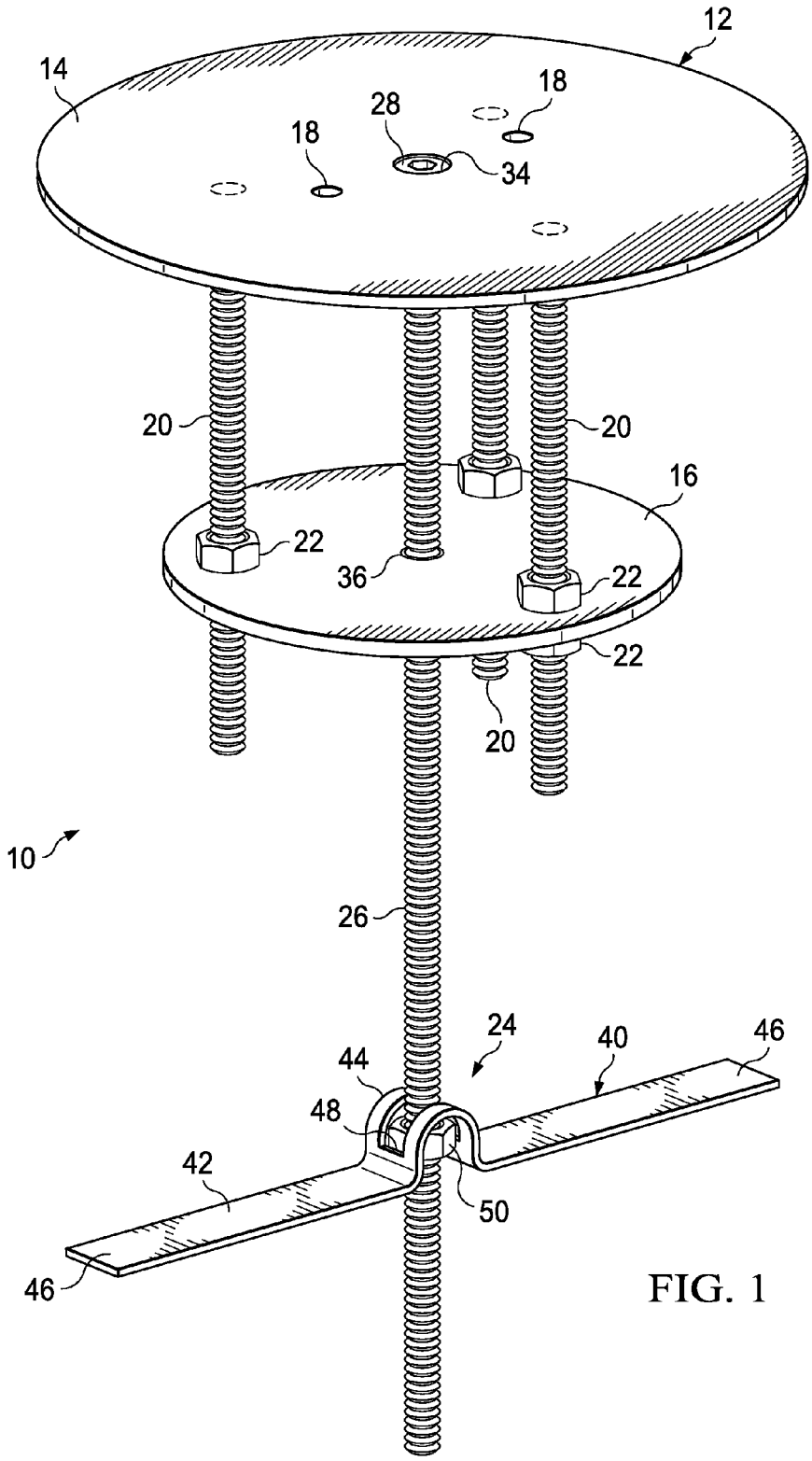
FIG. 1 is a perspective view of a seal assembly for a core hole constructed in accordance with an embodiment of the invention.

Referring to FIG. 1, a seal assembly 10 for a core hole is shown. As used herein, unless otherwise specified, the expression "core hole" is meant to encompass any opening or penetration within a concrete slab or other structures. Although the seal assembly 10 has particular application with concrete slabs or structures, the structures may include non-concrete structures as well. Although the invention has particular application to concrete slabs between floors of buildings, dwellings or other structures, it may have application to concrete walls or other structures that are not typically considered floors.

The core holes formed in concrete slabs or floors typically have a generally circular transverse cross section and may have a generally uniform diameter of about 2 inches (5.1 mm) or less to about 10 inches (25.4 cm) or more. The seal assembly 10 may be used and configured for core holes that are non-uniform in width and that have non-circular transverse cross-sectional shapes. Standard core holes typically have diameters of 4 inches (10.2 cm), 5 inches (12.7 cm) or 6 inches (15.2 cm). The core holes may have a depth of several inches, such as from about 4 inches (10 cm) or less to about 10 inches (25.4 cm) or more. Typical depths for the core holes may be about 3 inches (7.6 cm) to about 8 inches (20.3 cm). The seal assembly 10 may be configured for use with core holes of various depths or lengths. Typically the surface areas of the concrete slab or structure immediately surrounding the openings of the core hole may be relatively flat surfaces that lie in planes perpendicular to the longitudinal axis of the core hole. The seal assembly 10 may be configured for and used with such structures, but may also be configured for and used with slabs or structures were the surfaces are uneven or non-perpendicular to the core hole.

It should be noted that when a numerical range is presented herein as an example, or as being useful, suitable, etc., it is intended that any and every amount or point within the range, including the end points, is to be considered as having been stated. Furthermore, when the modifier "about" is used with reference to a range or numerical value, it should also be alternately read as to not include this modifier, and when the modifier "about" is not used with reference to a range or numerical value, the range or value should be alternately read as including the modifier "about."

The seal assembly 10 includes a cover assembly 12. The cover assembly 12 includes an upper cover plate 14 and a lower plate 16. The cover plate 14 may be a generally flat, circular steel plate. Other components of the seal assembly 10 may be formed from steel, iron or other metal material. The steel plate may have any suitable thickness, but a typical thickness is from about 0.05 inch (1.3 mm) to about 0.2 inch (5 mm) or more. Steel plate material of about 0.21 inch (i.e. 14 gauge or 1.98 mm) in thickness has been found suitable for many applications. Other materials besides steel may also be used for the plate 14 and other components of the seal assembly 10, which may be metal or non-metal. The thickness and type of material used for the plate 14 may depend upon the application for which the assembly 10 is to be used. In certain applications, the plate 14 and other components of the assembly 10 may be constructed to provide the desired strength and heat resistant characteristics for the structure it is to be used with. The cover plate 14 is configured and sized so that it engages and rests on the surface edges surrounding the opening of the core hole for which it is used and cannot be passed through the core hole. For a circular cover plate 14, the diameter of the plate is greater than the diameter of the core hole opening. The diameter of the cover plate 14 may be about ½ inch (1.3 cm) to about 2 inches (5.1 cm) greater or more than the diameter of the core hole opening for which it is used. Cover plates having a diameter of from about 2 inches (5.1 mm) to about 8 inches (20.3 mm) in diameter may be used in specific applications.

Figure 2:
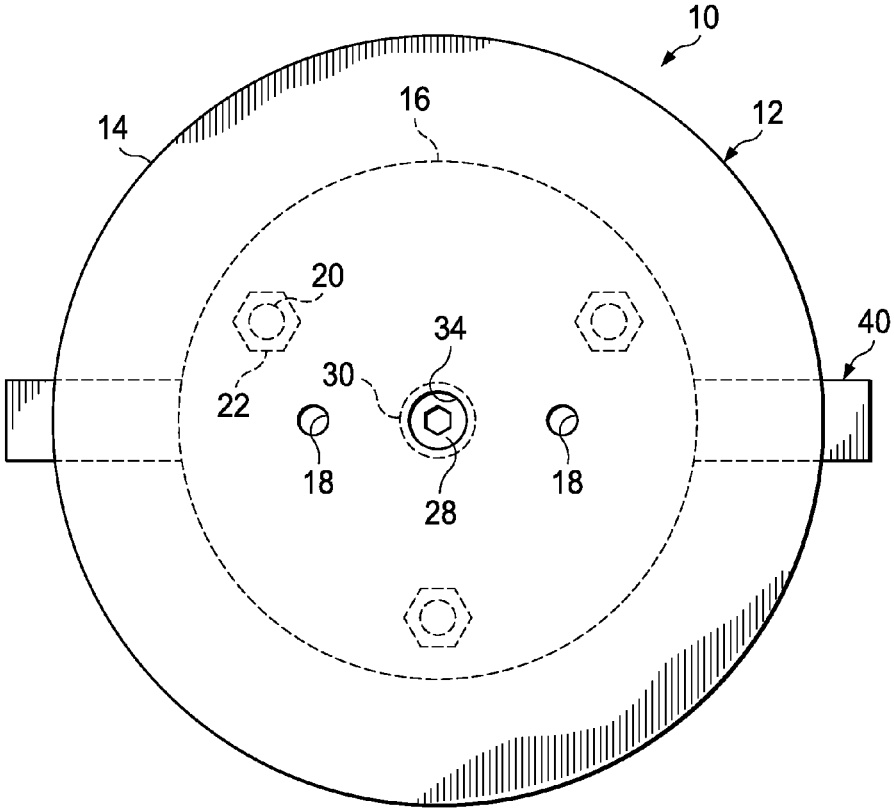
FIG. 2 is a top plan view of the seal assembly of FIG. 1.

Referring to FIG. 2, the plate 14 is provided with one or more small holes or apertures 18 that extend through the thickness of the plate for the introduction of an insulating material, as will be described more fully later on. In the embodiment shown, two holes 18 are provided that are linearly spaced apart approximately 1 inch (2.5 cm) or so on either side the center of the plate 14. Other means for the introducing the insulating foam may also be provided with the seal assembly 10.

The lower plate 16 may be formed from steel plate or other material. The construction of the lower plate 16 may be similar to that of the cover plate 14. The lower plate 16 is sized and configured to be received within the core hole. Thus, the lower plate 16 will typically have a smaller width or diameter than the cover plate 14. In certain applications, it may be desirable to provide the lower plate 16 with a size and configuration so that it is closely received within the core hole with which it is used. In certain embodiments, there may be a clearance of about 1/16 inch (1.5 mm) or less to about 1/4 inch (6.3 mm) or more between the lower plate 16 and the sides of the core hole interior in which it is received.

The lower plate 16 is coupled to the cover plate 14 through one or more support members 20 and may be generally concentric with and parallel to the cover plate 14. In some embodiments, the lower plate 16 may be non-adjustably coupled to the support member(s) 20 so that the lower plate 16 is non-movable relative to the cover plate 14. In the embodiment shown, the lower plate 16 is adjustably coupled to the support members 20 so that the lower plate 16 may be selectively spaced apart from the cover plate 14 at various distances. The support members 20 may be in the form of elongated steel rods that extend from the lower surface of the cover plate 14. The steel rods 20 may be helically threaded along their lengths, such as 1/4 inch (6.3 mm) all-thread rods that are threaded along generally their entire lengths. In other embodiments, the threads may be provided on only a portion of the support members 20. In the embodiment shown, the support members 20 are circumferentially spaced equally apart and pass through the lower plate 16. Apertures or holes (not shown) are provided in the lower plate 16 to accommodate passage of the support members 20 through the plate 16. The support members 20 may extend a suitable distance from the cover plate 14 to provide adequate spacing of the lower plate 16 from the cover plate 14. This may vary, but a suitable distance may be from about 2 inches (3.8 cm) to about 8 inches (20.3 cm) or about 10 inches (25.4 cm) or more.

Fasteners 22 may be used to secure the lower plate 16 to the support members 20. In the embodiment shown, the fasteners 22 are in the form of threaded nuts that are threaded onto the threaded rods 20 on either side of the lower plate 16. By repositioning the nuts 22, the position of the lower plate 16 relative to the cover plate 14 can be adjusted to various positions along the length of the support members 20.

In certain embodiments, a layer or sheet of insulation (not shown) may be applied to the upper and/or lower surface of the lower plate 16. The insulation may be a fire-retardant and/or intumescent material. The fasteners 22 may be used to facilitate securing the layer of material to the lower plate 16.

A locking assembly 24 is provided with the seal assembly 10. The locking assembly 24 includes a locking element carrier 26, which may be in the form of an elongated member or rod 26. The rod 26 may be a centrally located steel rod that extends from the center of the cover assembly 12. In the embodiment shown, the rod 26 is a threaded rod (e.g. 3/8 inch all-thread rod) in which all or a portion of the rod 26 is provided with helical threads along its length.

Figure 3:
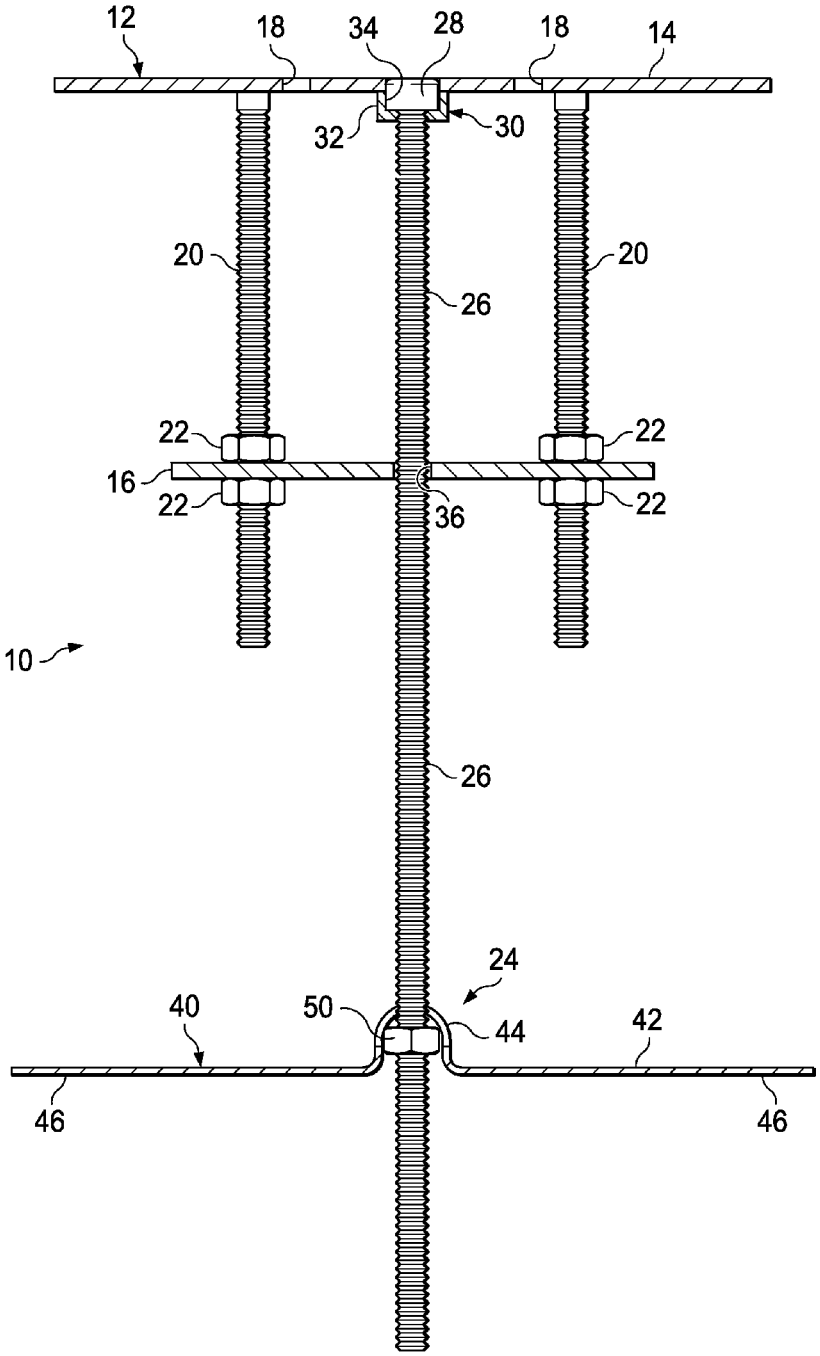
FIG. 3 is an elevational cross-sectional view of the seal assembly of FIG. 1.

Referring to FIG. 3, the upper end of the carrier 26 may be provided with a bolt head or other engagement portion 28. The bolt head or portion 28 is received by a carrier mount assembly 30 provided with the cover plate 14 to facilitate mounting of the carrier 26 to the cover assembly 12. The carrier mount assembly 30 may be in the form of a centrally located cup or well 32 that is coupled (such as by welding) on the lower surface of the cover plate 14 or formed as a recess of the cover plate 14. The bolt head 28 rests in the well 32, with the bolt head engaging shoulders of the well 32 that surround a central aperture of the well 32. The length of the carrier rod 26 extends through the central aperture of the well 32. Other means of securing the carrier 26 to the cover assembly 12 may also be used.

An aperture 34 formed in the center of the cover plate 14 allows access to the bolt or engagement portion 28. As shown, the top of the bolt or engagement portion 28 may be generally flush with the upper surface of the plate 14 when resting in the well 32 of the carrier mount assembly 30 and may substantially fill the aperture 34. In other embodiments the top of the bolt 28 may be slightly recessed from the surface of the plate 14. The engagement portion or bolt head 28 is configured to be engaged with one's fingers or a tool or other device for rotating the carrier 26, as will be discussed in more detail below. In one embodiment, the bolt head 28 is an Allen-head bolt head configured for engagement with an Allen wrench.

The carrier 26 extends from the carrier mount 30 and through the lower plate 16. A central hole or aperture 36 is provided in the lower plate 16 to accommodate the passage of the carrier 26. The aperture 36 may be sized to allow the carrier 26 to freely rotate within the aperture 36 while the plate 16 remains stationary. In certain embodiments, the carrier 26 may engage the lower plate 16, with the carrier constituting a support member for coupling the lower plate 16 to the cover plate 14. In such an embodiment, the supports 20 may be eliminated. Fasteners (not shown), like the fasteners 22, may be used to adjustably couple the lower plate 16 to the carrier 26 in a similar fashion as the supports 20. In such instances, the plate 16 may rotate with the carrier 26 within the core hole when tightening or loosening the seal assembly 10, as is described later on.

The carrier 26 may have a sufficient length such that it projects beyond the core hole and below the lower or opposite surface of the concrete slab or other structure with which it is used when the cover plate 14 is seated against it. In certain embodiments, the carrier rod may be from about 12 inches (30 cm) to about 24 inches (60 cm) in length. The length of the carrier 26 may vary, however, and depend upon the thickness of the concrete slab or other structure with which it used.

Figure 4A:
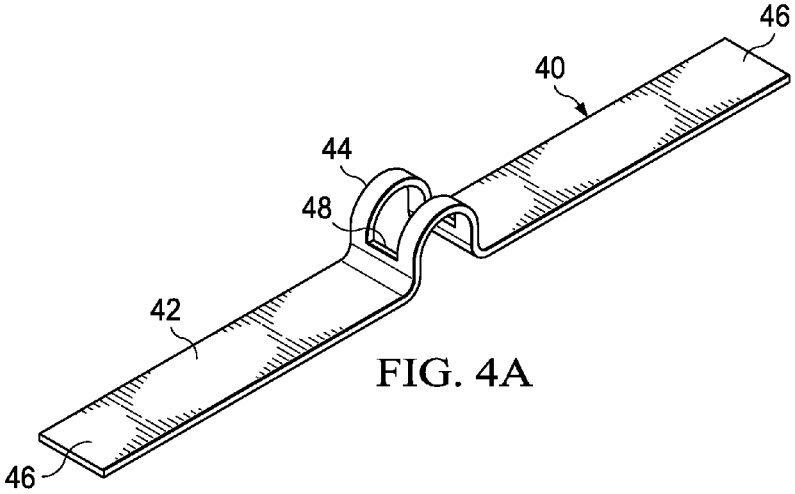
FIG. 4A is a perspective view of a locking member of the seal assembly of FIG. 1.
Figure 4B:
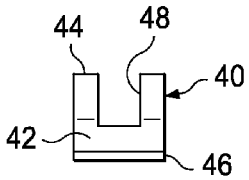
FIG. 4B is an elevation end view of the locking member of FIG. 4A.
Figure 4C:
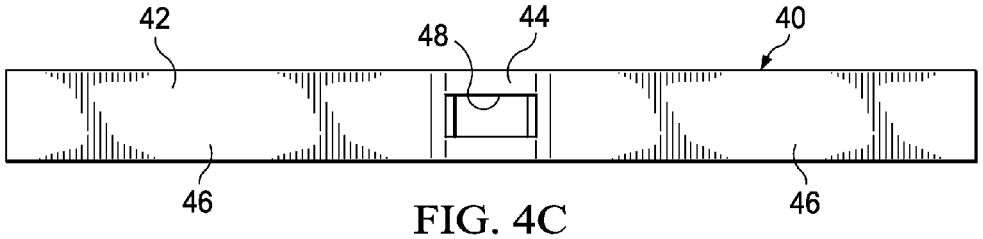
FIG. 4C is a top plan view of the locking member of FIG. 4A.

Located below the lower plate 16 and movably coupled to the carrier 30 is a locking element 40. The locking element 40 may take a variety of forms. The locking element 40 may be in the form of a toggle bolt that is movable between first and second pivotal positions. Referring to FIGS. 4A-4C, the locking element 40 includes an elongated body or member 42 having a central U-shaped bend 44 in the center of the body 42 from which extend opposite projecting portions or wings 46. The U-shaped bend 44 is provided with an elongated slot 48 to accommodate the carrier rod 26, which passes through the slot 48, and to allow pivotal movement of the body 42.

The locking element 40 may include a keeper 50 that is provided on the carrier 26 and retains the locking element member 42 on the carrier 26. In the embodiment shown, the keeper 50 is a nut that is threaded onto the threaded carrier rod 26. The threaded keeper 50 also allows the locking element 40 to be moved axially or longitudinally to various positions along the length of the carrier 26, as is described later on.

As can be seen, the elongated slot 48 allows the body 42 of the locking element 40 to pivot or rotate to different positions relative to the carrier rod 26, while the keeper 50 keeps the locking element body 42 coupled to the carrier 26. The pivoting or rotating motion of the locking member 42 may be along a transverse axis that is generally perpendicular or non-parallel to the longitudinal axis of the carrier rod 26. In this way, the locking element member 42 can be pivoted or rotated between a first retracted position, in which the ends of the projecting portions or wings 46 are moved towards the carrier 26, and a second extended position, in which the ends of the projecting portions 46 are moved away from the carrier 26 to a position where the longitudinal axis of the body 42 is generally perpendicular to the longitudinal axis of the carrier rod 26. The portions or wings 46 may be balanced in weight around the center of the U-shaped bend 44 so that when the U-shaped portion 44 is resting on the keeper 50, the body 42 will tend to rotate to the second extended perpendicular position. In certain embodiments, the body 42 of the locking element 40 may be rotated or pivoted from the second perpendicular position by as much as 75 degrees or more to the first position. When in the second extended position, the locking element member 42 should have a length that is greater than the cross dimension of the core hole with which it is used to facilitate securing of the seal assembly 10. As will be discussed later on, the U-shaped portion may engage the nut or keeper 50 when the locking element is in the second position so that it is held in a position that facilitates securing the seal assembly 10 in place.

Other toggles or locking elements or mechanisms may also be used with the seal assembly 10, such as those described in U.S. Pat. Nos. 978,380 and 3,940,636 and in U.S. Patent Pub. No. 2005/0129482, each of which is incorporated herein by reference.

Figure 5:
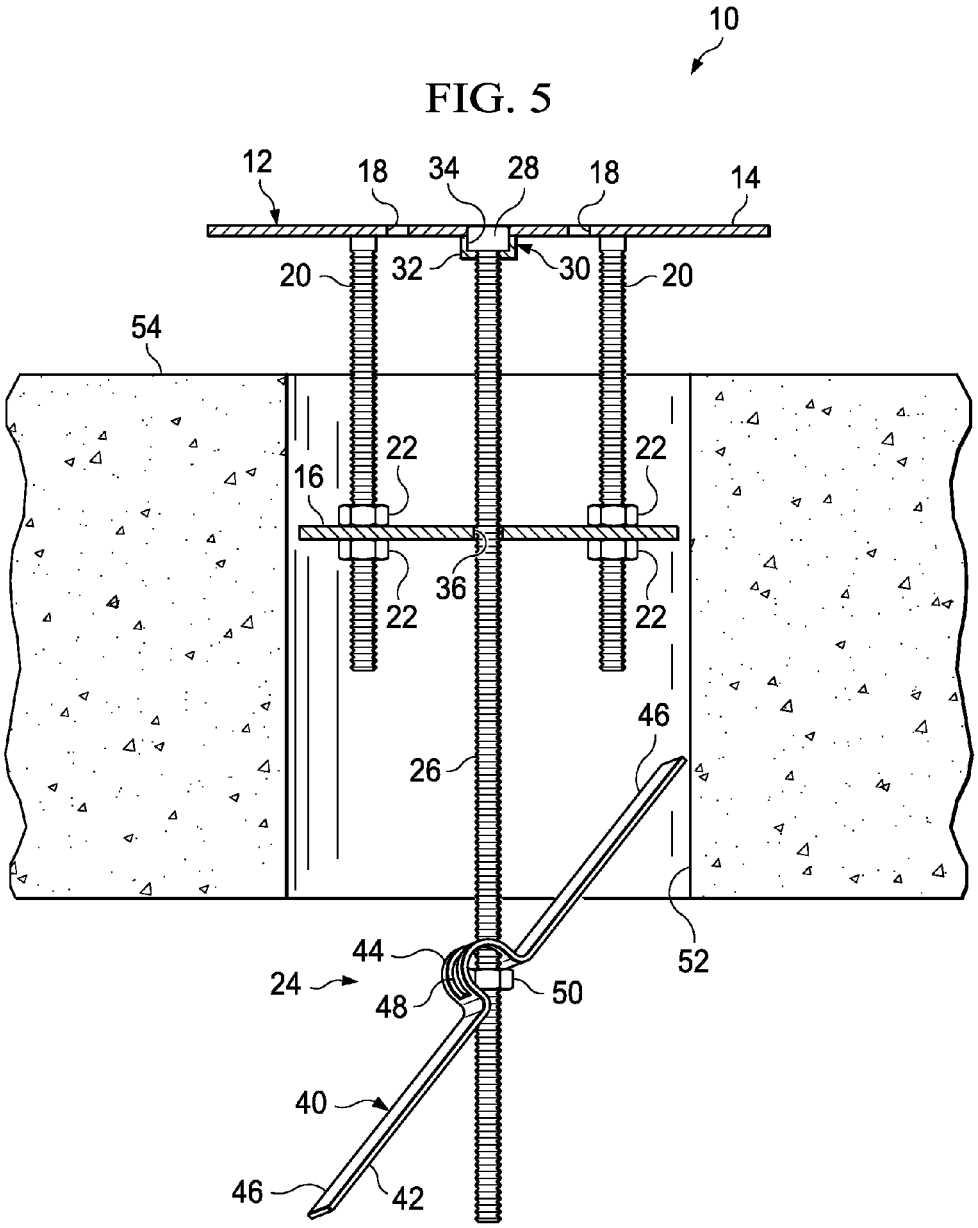
FIG. 5 is an elevational cross-sectional view of the seal assembly of FIG. 1 being installed within a concrete slab in accordance with the invention.
Figure 6:
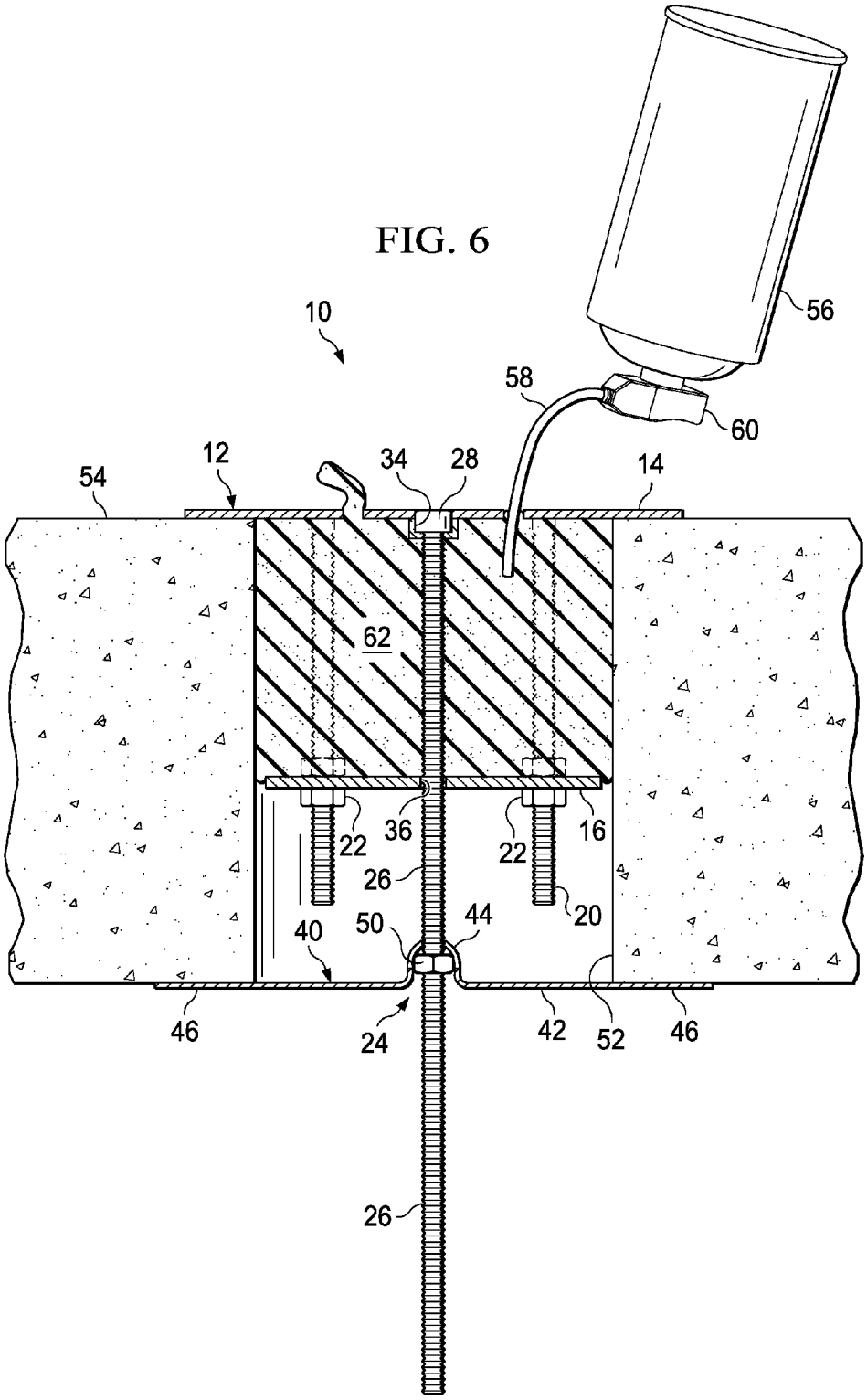
FIG. 6 is an elevational cross-sectional view of the seal assembly of FIG. 5 that is secured to the concrete slab and wherein a cavity formed by the seal assembly is filled with an insulating material.

FIGS. 5 and 6 illustrate the installation of the seal assembly 10 in a core hole 52 of a concrete slab 54. In the installation of the seal assembly 10, the lower plate 16 may be first positioned at the desired distance from the cover plate 14. This may be carried out by adjusting the positions of the fasteners 22 so that the lower plate 16 is retained on the support rods 20 at the desired position from the cover plate 14 (e.g. 3 inches or 7.6 cm).

With the lower plate 16 at the desired position, the carrier 26 with the locking element 40 is then introduced into the core hole 52, with the locking element 40 in the retracted position, as shown in FIG. 5, so that it may readily pass through the core hole 52. The locking element member 42 should be positioned on the carrier 26 so that when the carrier 26 is introduced through the core hole 52, the locking element member 42 will be located at a position below the lower surface of the core hole 52.

When the locking element member 42 is at a position below the core hole 52, the locking element 40 may be moved to the second extended position. This may result from the balanced projecting portions 46 of the locking element member 42 so that the locking element member 42 freely rotates to this position. Alternatively, the installer may move the seal assembly 10 slightly within the core hole so that one or both of the projections 46 of locking element 40 engages the lower surface of slab 54 surrounding the core hole 52 so that the locking element 40 can be pivoted or rotated to the second extended position.

When in the extended position, the locking element member 42 of the locking element 40 will have a length that is greater than the cross dimension or width of the core hole at the lower surface of the slab 54. By pulling upward on the seal assembly 10, the projections 46 of the locking element 40 will engage and abut against the lower surface of the slab 54. When sufficient force is exerted, the locking element member 42 will remain stationary while the installer rotates the carrier rod 26 by turning the bolt head 28, such as with an Allen-wrench. A power wrench may be used in certain cases to speed up the installation.

With the locking element in the extended position, the U-shaped portion 44 will lock onto the keeper nut 50 so that it also remains stationary. This causes the carrier rod 26 to feed or thread through the keeper nut 50 as the carrier rod 26 is rotated and lowers or closes the cover assembly 12 until the cover plate 14 securely engages and seats against the upper surface of the slab 54, as shown in FIG. 6, so that it is locked in place. As can be seen, the seal assembly 10 is locked in place using axial compression by engaging and locking onto opposite surfaces of the concrete slab 54. This is in contrast with devices that may expand circumferentially within the core hole to engage the sidewalls of the core hole. In the embodiment shown, the seal assembly 10 does not use such circumferential expansion or radial expansion within the core hole to engage the sidewalls of the core hole.

With the seal assembly 10 in place, a cavity is formed between the cover plate 14, the lower plate 16 and the walls of the core hole 52. In a further step, an amount of filler material 62 may be introduced into this cavity through one of the holes 18. The filler material 62 may an insulating material of a fire-retardant insulating foam, which may be an intumescent material. A spray can 56 may be provided and used containing an expandable foam. The spray can 56 may be provided with a flexible tube or conduit 58 connected to the nozzle 60 of the can 56 to facilitate introduction of the foam into the holes 18 of the cover plate 14. An example of a suitable expandable fire-retardant spray foam material is that available as Abesco FP200 FR Expanding Foam, available from Abesco, LLC, Orlando, Fla., which is a fire-rated polyurethane foam. As the foam 62 fills the cavity formed by the seal assembly 10, excess foam will begin to exit out the other of the holes 18. This indicates to the installer that the cavity formed between the plates 14, 16 is completely filled. Excess foam above the holes 18 may be removed. The foam will eventually cure to provide a fire-rated seal of the core hole. This completes the installation of the seal assembly. In certain embodiments, the seal assembly using such foam provides at least an International Building Code 3-hour fire rating when using a 3 inch (7.6 cm) thick layer of foam within the cavity.

The entire operation of installing the seal assembly 10 can take less than one minute.

Removal of the seal assembly 10 is also easily accomplished by rotating the carrier rod 26 by means of the bolt head 28 so that the carrier rod 26 passes upwards through the keeper nut 50 and the cover assembly 12 is lifted. The locking element 40 is thus loosened and disengages from the slab 54. The locking element 40 can then be moved to the retracted position so that it can passed upward through the core hole 52 to allow removal of the seal assembly 10.

In certain embodiments, some or all of the components of the seal assembly may be formed with or coated with an insulating material or a fire-retardant or intumescent material. In one embodiment, a further body (not shown) of a insulating material, fire-retardant and/or intumescent material may be provided on the seal assembly 10 at a position below the lower plate 16 that generally fills all or a portion of the core hole below the lower plate 16. The further body may be coupled to the lower plate or other components of the seal assembly.

The seal assembly or assemblies may be provided as a kit that is complete with wrenches (including one for both manual use and for use in a power tool), a can of insulating foam and instructions for installing in one or more core holes.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A method of sealing a core hole formed in a concrete slab having opposite first and second surfaces, with the core hole extending between the first and second surfaces, the method comprising:

providing a seal assembly for sealing the core hole, the seal assembly comprising:

(1) a cover assembly that includes a cover plate and a lower plate that is coupled to the cover plate through a support member;

(2) a locking element carrier that is coupled to the cover assembly and extends from the cover assembly through the core hole when the cover plate is seated over the core hole; and (3) a locking element that is movably coupled to the locking element carrier, the locking element being configured for movement between first and second positions, the locking element being configured to pass through the core hole when the locking element carrier is passed through the core hole while in the first position, and wherein the locking element is configured to engage the second surface of the concrete slab when in the second position and prevent passage of the locking element through the core hole, the locking element being selectively movable upon the locking element carrier to facilitate securing the seal assembly to the concrete slab;

installing the seal assembly by passing the locking element carrier and locking element through the core hole while the locking element is in the first position;

moving the locking element to the second position so that the locking element engages the second surface of the concrete slab; and moving the locking element upon the locking element carrier to facilitate securing the seal assembly to the concrete slab so that the cover plate engages the first surface of the concrete slab and seats over and covers the core hole, and the lower plate member being received within the core hole and being spaced apart from the cover plate when the cover plate is seated over the core hole to define a cavity between the lower plate and the cover plate.

2. The method of claim 1, further comprising:

introducing an insulating material into the cavity between the lower plate and the cover plate.

3. The method of claim 2, wherein:

the insulating material is an expandable spray foam.

4. The method of claim 1, wherein:

the insulating material is a fire-retardant and/or intumescent material.

5. The method of claim 1, wherein:

the locking element is pivotally or rotatably moved between the first and second positions.

6. The method of claim 1, wherein:

the lower plate is adjustably coupled to the cover plate through the support member so that the lower plate may be selectively spaced apart from the cover plate at different positions.

7. The method of claim 1, further comprising:

introducing an insulating material into the cavity between the lower plate and the cover plate through at least one aperture that is formed in the cover plate when the cover plate is seated over the core hole.

8. The method of claim 1, wherein:

the locking element carrier is an elongated threaded member.

9. The method of claim 8, wherein:

the locking element has a threaded portion that engages the elongated threaded member, and wherein rotating the elongated threaded member facilitates movement of the locking element along the length of the elongated threaded member to thereby tighten or loosen the locking element.

10. The method of claim 8, wherein:

the elongated threaded member extends to the cover plate and is provided with an engagement portion at the cover plate to allow the elongated threaded member to be rotated to thereby tighten or loosen the locking element.

11. The method of claim 1, wherein:

the support member extends from the cover plate a distance of from about 2 inches to about 10 inches.

12. The method of claim 1, wherein:

the locking element carrier has a length of from about 12 inches to about 24 inches.

13. The method of claim 1, wherein:

the locking element is pivotally or rotatably moved between first and second positions about a transverse axis of the locking element carrier.

14. The method of claim 1, wherein:

the locking element is selectively movable axially or longitudinally along the length of the locking element carrier.

15. A method of sealing a core hole formed in a concrete slab having opposite first and second surfaces, with the core hole extending between the first and second surfaces, the method comprising:

providing a seal assembly for sealing the core hole, the seal assembly comprising:

(1) a cover assembly that includes a cover plate and a lower plate that is coupled to the cover plate through a support member;

(2) a locking element carrier that is coupled to the cover assembly and extends from the cover assembly through the core hole when the cover plate is seated over the core hole; and (3) a locking element that is movably coupled to the locking element carrier, the locking element being configured for movement between first and second positions, the locking element being configured to pass through the core hole when the locking element carrier is passed through the core hole while in the first position, and wherein the locking element is configured to engage the second surface of the concrete slab when in the second position and prevent passage of the locking element through the core hole, the locking element being selectively movable upon the locking element carrier to facilitate securing the seal assembly to the concrete slab;

installing the seal assembly by passing the locking element carrier and locking element through the core hole while the locking element is in the first position;

moving the locking element to the second position so that the locking element engages the second surface of the concrete slab;

moving the locking element upon the locking element carrier to facilitate securing the seal assembly to the concrete slab so that the cover plate engages the first surface of the concrete slab and seats over and covers the core hole, and the lower plate member being received within the core hole and being spaced apart from the cover plate when the cover plate is seated over the core hole to define a cavity between the lower plate and the cover plate; and introducing an insulating material into the cavity between the lower plate and the cover plate.

16. The method of claim 15, wherein:

the insulating material is an expandable spray foam.

17. The method of claim 16, wherein:

the insulating material is a fire-retardant and/or intumescent material.

18. The method of claim 15, wherein:

the locking element is pivotally or rotatably moved between the first and second positions.

* * * * *